US012158089B2

(12) United States Patent
Müller et al.

(10) Patent No.: US 12,158,089 B2
(45) Date of Patent: Dec. 3, 2024

(54) ROTOR FOR A CAMSHAFT PHASER

(71) Applicant: Miba Sinter Austria GmbH, Laakirchen (AT)

(72) Inventors: Alexander Müller, Altmünster (AT); Wolfgang Siessl, Traunkirchen (AT)

(73) Assignee: Miba Sinter Austria GmbH, Laakirchen (AT)

( * ) Notice: Subject to any disclaimer, the term of this patent is extended or adjusted under 35 U.S.C. 154(b) by 0 days.

(21) Appl. No.: 18/356,199

(22) Filed: Jul. 20, 2023

(65) Prior Publication Data

US 2024/0026805 A1 Jan. 25, 2024

(30) Foreign Application Priority Data

Jul. 22, 2022 (AT) ..... A 50557/2022

(51) Int. Cl.
*F01L 1/344* (2006.01)

(52) U.S. Cl.
CPC ..... *F01L 1/3442* (2013.01); *F01L 2001/3445* (2013.01)

(58) Field of Classification Search
CPC ..... F01L 2001/3445; F01L 1/3442; F01L 2820/01
See application file for complete search history.

(56) References Cited

U.S. PATENT DOCUMENTS

| | | | | |
|---|---|---|---|---|
| 8,851,034 | B2 | 10/2014 | Boese et al. | |
| 10,413,967 | B2 | 9/2019 | Tausend et al. | |
| 10,584,617 | B2 | 3/2020 | Weber | |
| 11,629,619 | B2 | 4/2023 | Mueller et al. | |
| 2016/0076408 | A1* | 3/2016 | Nagura | F01L 1/3442 123/90.15 |
| 2022/0056818 | A1 | 2/2022 | Mueller et al. | |
| 2022/0056819 | A1* | 2/2022 | Mittermair | B22F 3/164 |

FOREIGN PATENT DOCUMENTS

| | | | | |
|---|---|---|---|---|
| AT | 524197 | A1 | 3/2022 | |
| DE | 102013207747 | A1 | 10/2014 | |
| DE | 102013015677 | A1 | 3/2015 | |
| DE | 102013226445 | A1 | 6/2015 | |
| DE | 102017110091 | A1 | 3/2018 | |
| DE | 102018101979 | A1 | 8/2019 | |
| DE | 102012213176 | B4 | 7/2021 | |
| DE | 102021119625 | A1 | 2/2022 | |
| EP | 2977569 | A1 * | 1/2016 | F01L 1/34409 |

* cited by examiner

*Primary Examiner* — Ngoc T Nguyen
(74) *Attorney, Agent, or Firm* — Stoel Rives LLP

(57) ABSTRACT

A powder-metallurgically produced rotor for a camshaft adjuster includes a rotor base body having an outer diameter bounded by a radially outer lateral surface and passing through a first axis of rotation, and an inner diameter bounded by a radially inner lateral surface and passing through a second axis of rotation. The rotor has blades projecting radially outward from the radially outer lateral surface and a calibrated first annular web projecting radially inward on the inner lateral surface, which has a web lateral surface defining a bore passing through the rotor base body in the axial direction and having an inside diameter passing through a third axis of rotation, wherein the third axis of rotation is offset in the radial direction by at most 0.1 mm relative to the first axis of rotation and/or the second axis of rotation.

20 Claims, 4 Drawing Sheets

ROTOR FOR A CAMSHAFT PHASER

CROSS-REFERENCE TO RELATED APPLICATIONS

This application claims priority under 35 U.S.C. § 119 (a)-(d) of Austrian Patent Application No. A50557/2022, filed Jul. 22, 2022, which is hereby incorporated by reference in its entirety.

TECHNICAL FIELD

The field of the present disclosure relates to powder-metallurgically produced rotors for camshaft adjusters, and to hydraulic camshaft adjusters including such rotors for adjusting the valve timing in internal combustion engines.

BACKGROUND

Camshaft adjusters are known to serve for adjusting the valve opening times in order to thus achieve a higher efficiency of a combustion engine. Various embodiments of them are known from the prior art. A generic hydraulic camshaft adjuster comprises a stator, in which a rotor is arranged. The rotor is connected to the camshaft so as to be prevented from rotating in relation thereto. The stator, which is connected to the crankshaft, has webs protruding radially inwards, which webs form the stop faces for the blades of the rotor. Thus, the rotor can only by rotated by a predefined angle range relative to the stator.

In this context, it is also known to powder-metallurgically produce at least parts of a camshaft adjuster from sintering materials. For example, DE 10 2013 226 445 A1 describes a camshaft adjuster for an internal combustion engine of the vane cell type, having a stator and a rotor, which can be rotated relative to the stator and which consists of a plurality of rotor parts which are connected to one another, wherein the rotor can be connected to a camshaft of the internal combustion engine so as to be prevented from rotating in relation thereto, and a first rotor part is configured in such a way that the camshaft is supported with contact on the first rotor part in an operating state, wherein the first rotor part is produced by means of a sintering process, and at least a first supporting surface, which supports the camshaft, of the first rotor part is set geometrically by means of a non-cutting processing operation.

DE 10 2013 015 677 A1 describes a method for producing a sintered part with high radial precision, wherein the sintered part is produced from at least a first sintered adherend and a second sintered adherend, and wherein the method comprises at least the following steps: joining the first sintered adherend to the second sintered adherend, causing the high radial precision, having a deformation of at least one radial deformation element, which is preferably positioned so as to adjoin a joining contact zone, wherein deforming the radial deformation element is effected at least by a calibration tool and is carried out substantially as a plastic deformation of the radial deformation element.

DE 10 2018 101 979 A1 describes a hydraulic camshaft adjuster for variably adjusting the engine valve timing of gas exchange valves of an internal combustion engine with a stator and a rotor that is rotatable relative to the stator, wherein webs protruding radially inwards are formed on the stator, wherein blades protruding radially outwards are formed on the rotor, wherein multiple hydraulic working spaces are formed between the stator and the rotor, each of which working spaces being subdivided into a first working chamber and a second working chamber by a blade of the rotor, and wherein the stator comprises a first stator component and a second stator component, which are arranged concentrically about a common axis of rotation, wherein a first stop for a blade of the rotor is formed on the first stator component, wherein a second stop for a blade of the rotor is formed on the second stator component, and wherein the adjustment range of the rotor is defined by the positioning of the two stator components relative to each other.

From AT 524197 A1, a one-piece rotor for a camshaft adjuster made of a sintering material is known, comprising a rotor base body having blades projecting radially outwardly from a radially outer circumferential surface, the rotor having first planar surfaces on a first front face and second planar surfaces on a second front face disposed opposite the first front face as viewed in an axial direction, wherein the first planar surfaces and the second planar surfaces of the rotor are ground or finished, and the lateral surface of the rotor is uncalibrated.

DE 10 2012 213 176 B4 describes a hydraulic camshaft adjuster for an internal combustion engine having an outer rotor and an inner rotor, the outer rotor and the inner rotor being rotationally adjustable and arranged concentrically about a common axis of rotation, at least one hydraulic chamber being formed between the outer rotor and the inner rotor, into which hydraulic chamber at least one connected vane extends from each of the outer rotor and the inner rotor, whereby said hydraulic chamber is divided into at least one pressure chamber pair of two pressure chambers, said inner rotor having an opening concentrically arranged in said axis of rotation, wherein a sealing portion is formed on the inner surface of said opening between two axial sides of said inner rotor, said opening having a larger cross-sectional area on both sides of said sealing portion than in said sealing portion. The inner rotor is a sintered component and the sealing portion of the inner rotor is calibrated.

The inventors have recognized a need for an improved hydraulic camshaft adjuster and means of simplifying its production.

SUMMARY

A powder-metallurgically produced rotor for a camshaft adjuster made of a sintering material comprises a rotor base body having a radially outer lateral surface and a radially inner lateral surface as well as a first front face and a second front face, which, viewed in an axial direction, is arranged opposite the first front face, wherein the rotor base body has an outer diameter bounded by the radially outer lateral surface and passing through a first axis of rotation, and an inner diameter bounded by the radially inner lateral surface and passing through a second axis of rotation, and which has blades projecting radially outward from the radially outer lateral surface and a calibrated first annular web projecting radially inward on the inner lateral surface, which has a web lateral surface defining a bore passing through the rotor base body in the axial direction and having an inside diameter passing through a third axis of rotation that is offset in the radial direction by a value relative to the first axis of rotation and/or the second axis of rotation which is at most 0.1 mm.

Such a rotor may be included as part of a hydraulic camshaft adjuster for variably adjusting the timing of gas exchange valves of an internal combustion engine, wherein a rotor according to the present disclosure is at least partially surrounded by a stator, and a control valve of the adjustor is at least partially surrounded by the rotor.

Embodiments according to the present disclosure may permit a relatively large tolerance range of the coaxiality, which may simplify the production of the rotor and make it more cost-effective. Contrary to what might be expected, however, the reduction in the precision of the dimensions of the rotor does not affect the functionality of the camshaft adjuster. Any necessary adjustments of the rotor to the stator can be made on its outer surfaces, which can simplify the machining of the sintered rotor.

According to an embodiment, it may be provided that the third axis of rotation is offset in the radial direction by a value relative to the first axis of rotation and/or the second axis of rotation, which is between 0.04 mm and 0.08 mm. In particular in the range of the minimum deviation of 0.04 mm, an adjustment of other dimensions of the rotor can be avoided, so that in particular also the outer diameter of the rotor base body can remain unchanged. However, even with a maximum value of 0.08 mm, no further machining of the sintered rotor is usually required.

According to another embodiment, in order to improve the functionality of the rotor with respect to fluid guidance, it may be provided that a further annular web is arranged downstream of and spaced from the first annular web in the axial direction.

According to an embodiment, it may be provided that the further annular web has a radial height that is smaller than a radial height of the first annular web. This makes it easier to calibrate the two annular webs simultaneously.

Also, to simplify calibration of the annular web by making it easier to insert the calibration tool, it may be provided in accordance with an embodiment that transitions between the web lateral surface and directly adjoining front surfaces of the first annular web and/or between the front surfaces of the first annular web and the radially inner lateral surface of the rotor base body are rounded or faceted. In addition, material chipping in the edge area can be avoided. With the rounding or faceting in the foot area of the annular web, an area can be made available for the compression of material during calibration, where in addition the annular web can be given greater stability in the foot area. In addition, this can improve the flow behavior of the fluid in the rotor.

For the same reasons, according to another embodiment it may be provided that the further annular web has a further web lateral surface and further front faces directly adjoining the latter, and that transitions between the further web lateral surface and the further front faces directly adjoining the latter and/or between the further front faces of the further annular web and the radially inner lateral surface of the rotor base body are rounded or faceted.

According to an embodiment, it may be provided that the annular web in an outer layer with a layer thickness of 0.5 mm has a maximum density of not less than 95% of the theoretical density of the sintering material. This is relatively easy to achieve with the calibration step if the calibration tool is appropriately designed, and gives the annular web improved load-bearing capacity, although a higher porosity would in itself be preferable as lubricant or the fluid of the camshaft adjuster can be stored.

BRIEF DESCRIPTION OF THE DRAWINGS

For the purpose of better understanding of the invention, it will be elucidated in more detail by means of the figures below.

These show in a simplified schematic representation.

DETAILED DESCRIPTION

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 1:
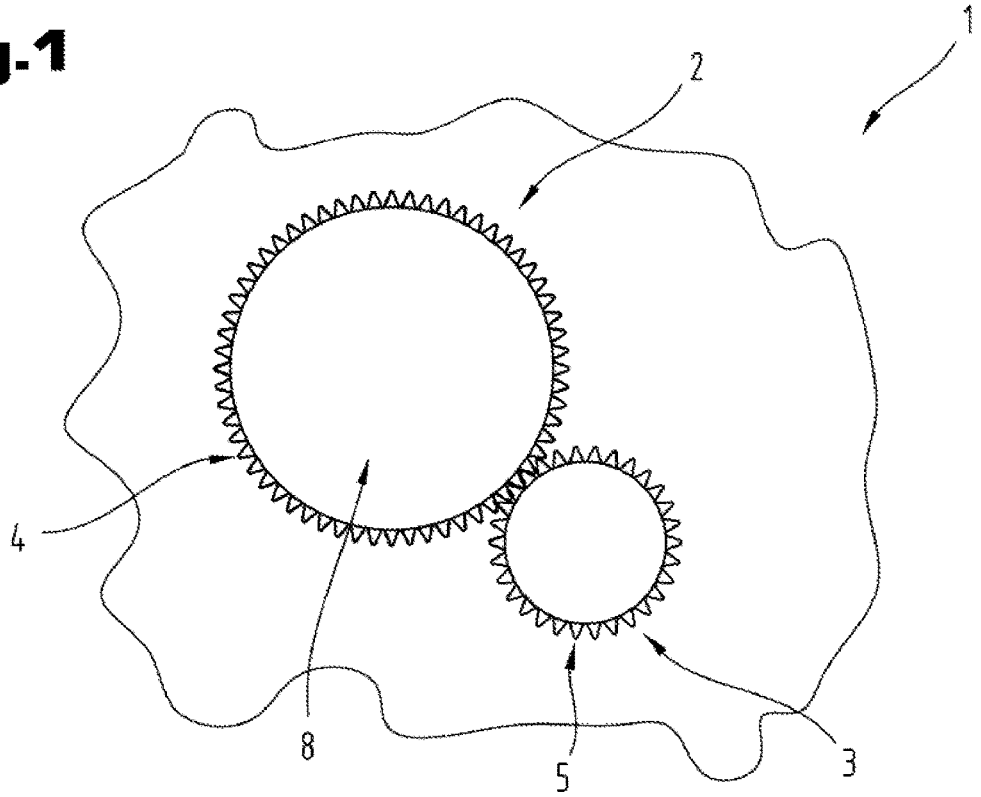
FIG. 1 a cutout from a combustion engine.

FIG. 1 shows a cutout from a combustion engine 1. A hydraulic camshaft adjuster 2 and a drive wheel 3 are shown. The camshaft adjuster 2 has a spur gearing 4 on its outer circumference. The drive wheel 3 also has a spur gearing 5 on its outer circumference. The two spur gearings 4, 5 are arranged in a meshing engagement with one another.

The spur gearing 4 of the camshaft adjuster 2 can also be configured for engaging with a timing chain or a driving belt (not shown).

In principle, this configuration of hydraulic camshaft adjusters 2 is known from the prior art, so that further explanations regarding this can be dispensed with.

Figure 3:
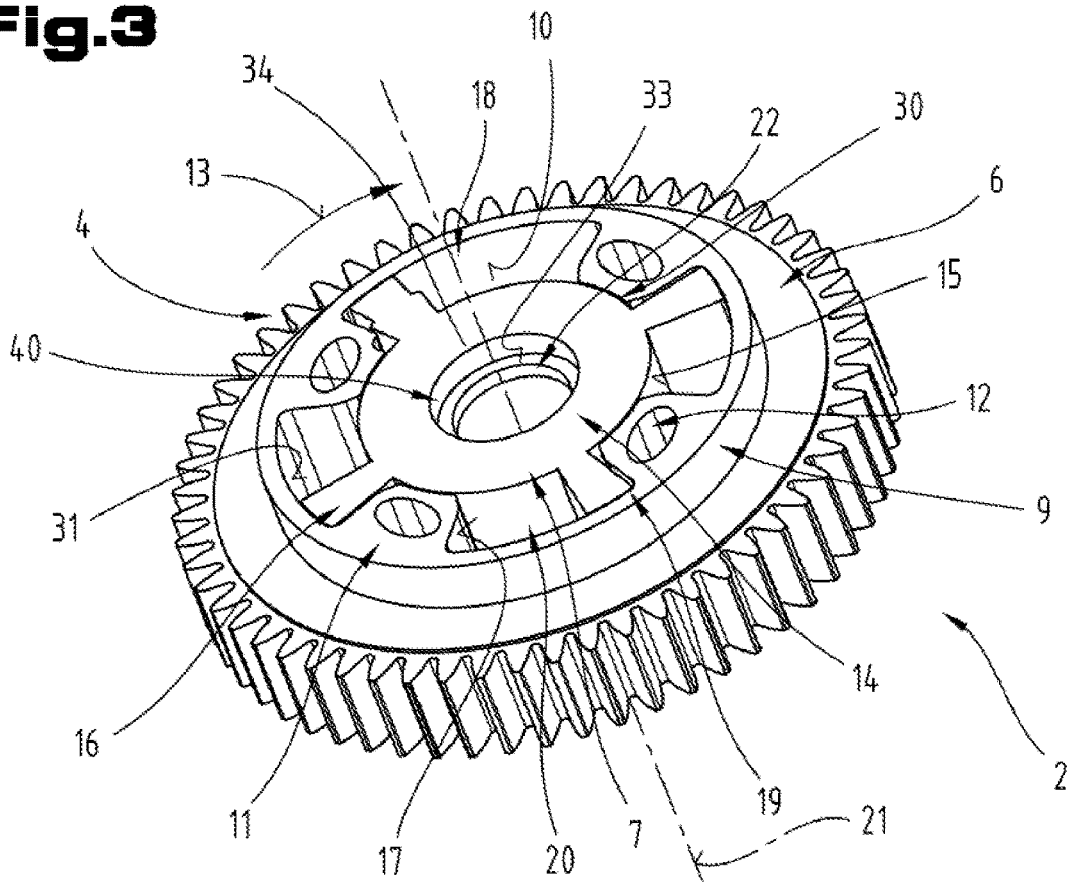
FIG. 3 the stator and the rotor of the camshaft adjuster according to FIG. 2 in an oblique view.
Figure 2:
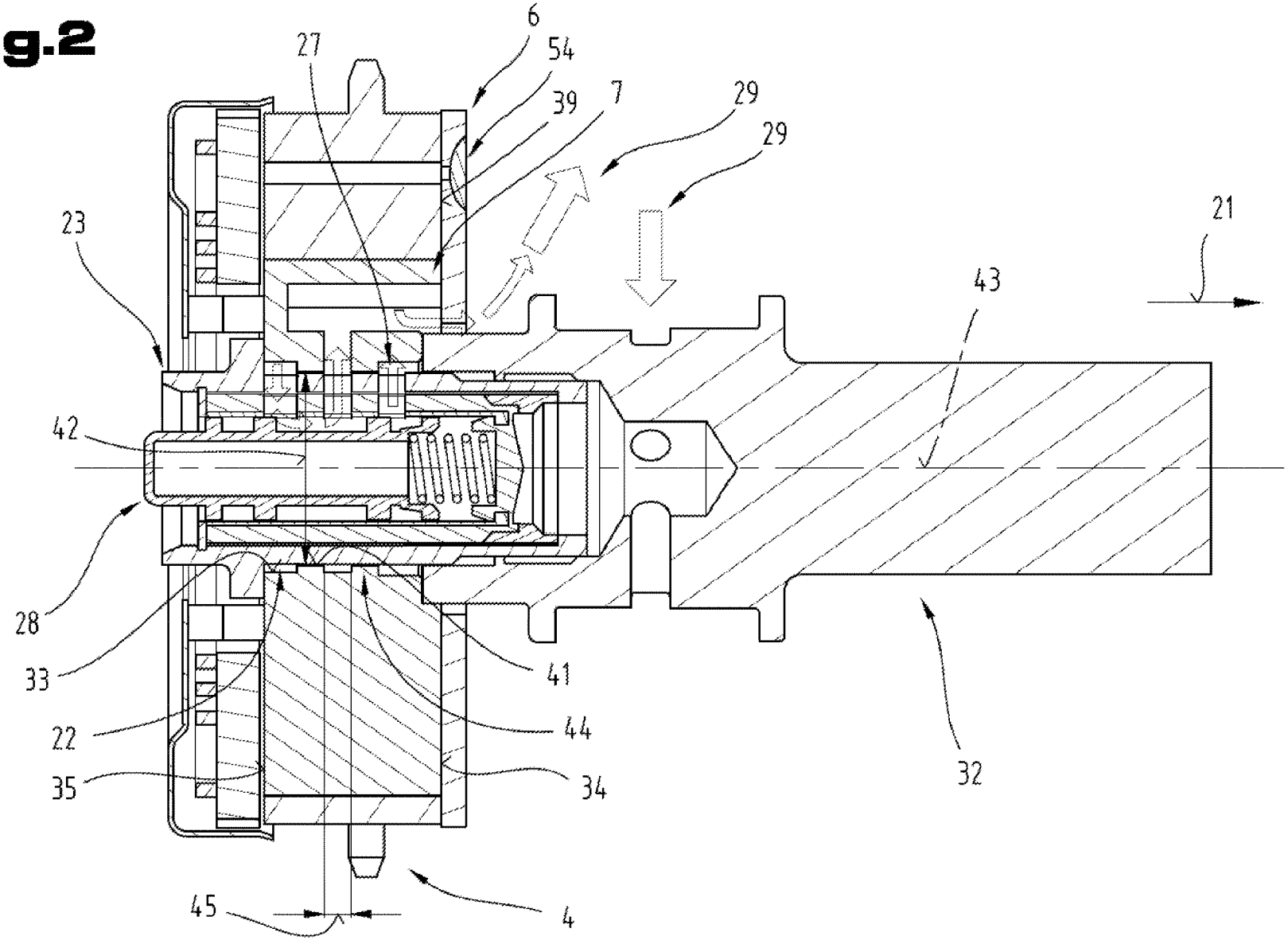
FIG. 2 a cutout from a hydraulic camshaft adjuster in a longitudinal section.
Figure 4:
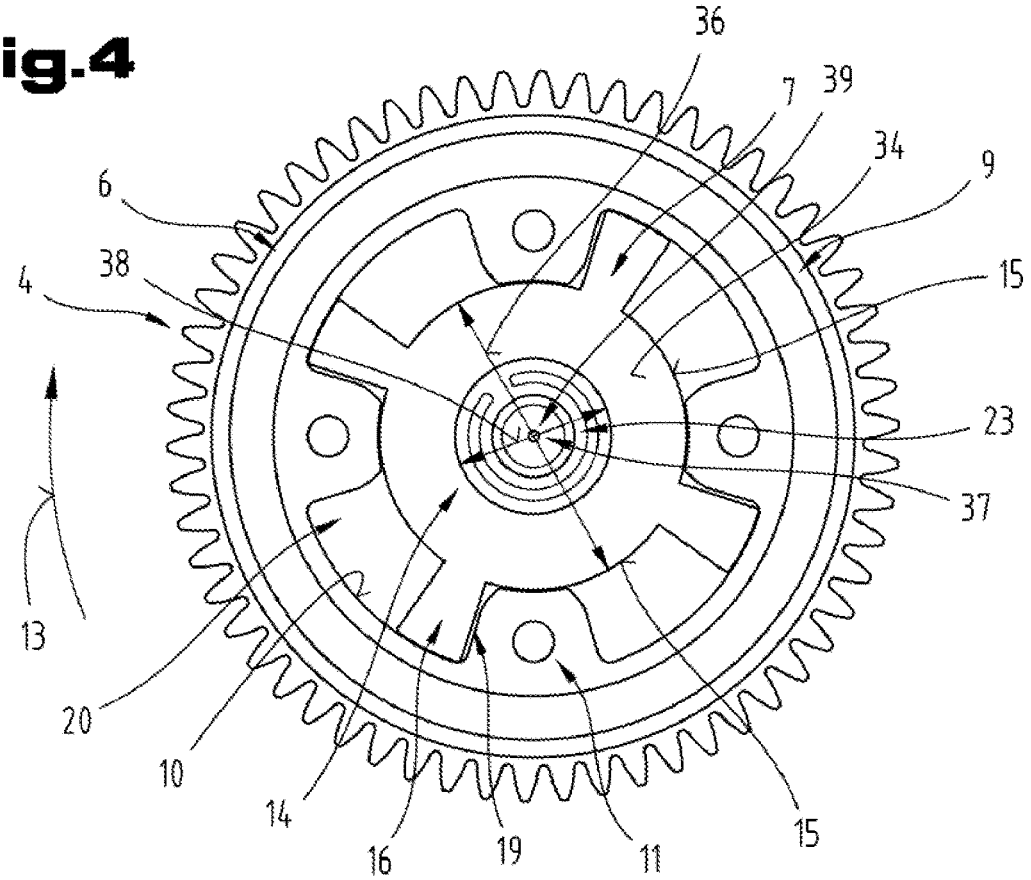
FIG. 4 the stator and the rotor of the camshaft adjuster according to FIG. 2 in a front view.

As can be seen in FIGS. 2 to 4, the camshaft adjuster 2 has a stator 6 and a rotor 7. The representation of a covering 8 on the front side of the camshaft adjuster 2 that can be seen in FIG. 1 was dispensed with in FIGS. 3 and 4.

The stator 6 has an annular stator base body 9, which, as already mentioned, may have the external toothing in the form of the end toothing 4 on its outer circumference. Webs 11 are formed on a radially inner lateral surface 10 of the stator base body 9 so as to protrude radially inwards beyond said lateral surface 10. In the particular case, the stator 6 has four webs 11. This number of webs 11, however, is not to be understood as limiting. It is also possible for more or fewer webs 11 to be present. The webs 11 may optionally be provided with a recess 12 and/or an opening in order to lower the weight of the stator 6. The webs 11 are arranged on the stator base body 9 so as to be distanced from one another in a circumferential direction 13.

Inside the stator 6, the rotor 7 is completely or at least partially arranged. The rotor 7 has an (annular) rotor base body 14. On an outer lateral surface 15 of said rotor base body 14, blades 16 are formed and/or arranged, which extend radially outwards starting from the lateral surface 15. In an assembled state of the camshaft adjuster 2, said blades 16 are arranged between the webs 11 of the stator 6. Side surfaces 17 of the webs 11 may thereby form the stop surfaces for the blades 16 of the rotor 7, as can be seen in FIG. 3.

The number of blades 16 of the rotor 7 is determined by the number of webs 11 of the stator 6, with the result that, in the specific case, thus four blades 16 are present.

The webs 11 define hydraulic working spaces 18. One working space 18 each is limited in the circumferential direction 13 by two webs 11. The blades 16, which are arranged between the webs 11, divide the working spaces 18 into a first working chamber 19 and a second working chamber 20, in each case by means of one blade 16 of the rotor 7. The relative position of the rotor 7 to the stator 6 can be changed by means of the fluid which can be introduced into said working chambers 19, 20, as it is known per se, so that regarding this, reference is made to the relevant prior art.

It should be noted that the hydraulic embodiment of the camshaft adjuster 2 is the preferred one. However, the camshaft adjuster 2 can also be designed differently.

The rotor 7 is thus arranged within the stator 6 so as to be rotatable (pivotable) relative to the stator 6 in the circumferential direction 13, wherein the path of the rotatability (pivotability) is limited by the webs 11. The camshaft adjuster 2 thus works according to the principle of a swivel motor. Driven by a chain or belt drive or the drive wheel 3, the camshaft adjuster 2 adjusts the opening and closing times of the gas exchange valves relative to the driving shaft, such as the crankshaft, at an earlier or later time in order to influence the combustion process in the internal combustion engine. In this regard, the camshaft is adjusted either in the direction "early" or in the direction "late" by filling the opposing working chambers 19, 20 forming between the rotor 7 and the stator 6 of the camshaft adjuster 2 with a suitable hydraulic medium.

A control valve 23 (which may also be referred to as central valve) is arranged at least partially inside a recess 22 of the rotor 7 extending in an axial direction 21 and/or particularly passing through the rotor 7, meaning so as to be at least partially surrounded by the rotor 7.

Figure 5:
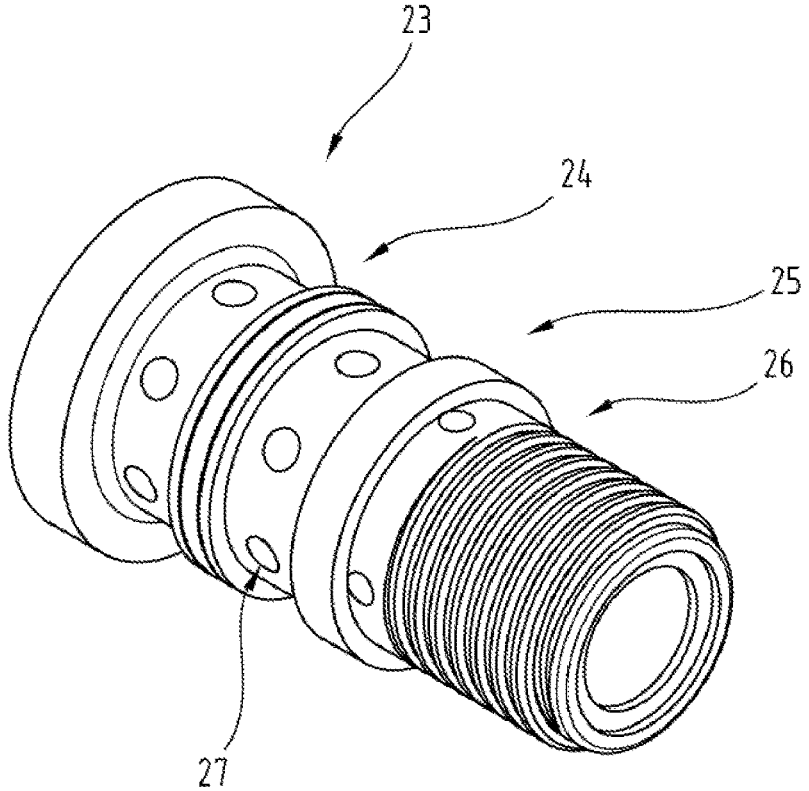
FIG. 5 a control valve.

FIG. 5 shows an embodiment of the control valve 23. This control valve 23 is provided with several conical or cylindrical portions 24-26 with breakthroughs 27 (bores) through which hydraulic fluid is supplied to or discharged from the working chambers 19, 20 depending on the position of a piston 28 (FIG. 2). A circuit for the hydraulic fluid (in particular, an oil) is adumbrated with arrows 29 in FIG. 2.

For the sake of completeness, it should be mentioned that the working chambers 18, and thus also the working chambers 19, 20, are bounded radially inwards by a surface 30 of the rotor base body 14 (in particular by its lateral surface 15) and radially outwards by a surface 31 of the stator base body 9 (in particular by its lateral surface 10).

Furthermore, seals may be arranged on the blades 16, which seals seal a distance between the blades 16 and the surface 31 (in particular the lateral surface 10) during operation of the hydraulic camshaft adjuster 2. These seals may be arranged partially inside the blades 16, for which purpose the blades 16 may have slits, as is adumbrated in dashed lines in FIG. 4.

Feeding the hydraulic fluid to the working chambers 19, 20 can be carried out by means of a camshaft 32, which is arranged on the camshaft adjuster 2.

For conducting the hydraulic fluid, corresponding channels and/or lines may be provided and/or arranged in components of the camshaft adjuster 2 and/or the camshaft 32.

The rotor 7 is powder-metallurgically produced, preferably as a one-piece sintered component, so that the blades 16 form a single integral sintered component with the rotor base body 14.

The stator 6 can be a one-piece component, in particular a sintered component.

For further details on hydraulic camshaft adjusters 2, which are not related to the invention, reference is made to the relevant prior art.

The rotor 7 is manufactured using a powder-metallurgical method. This method comprises the method steps:

- providing a first powder for producing the rotor 7 in a mold cavity of a mold;
- pressing the first powder to form a rotor green compact in the mold;
- possibly green machining the rotor green compact;
- sintering the rotor green compact;
- calibrating the sintered rotor;
- possibly post-processing by means of material removal of the rotor;
- possibly washing and packing.

The green machining and/or the post-processing by means of material removal of the stator 6 and/or of the rotor 7 can be carried out for example by sanding, lapping, honing etc.

The sintering of the rotor 7 may be carried out in one or more stages. Moreover, it can be carried out at a temperature of 700° C. to 1300° C. for a period of 10 minutes to 120 minutes, for instance.

As the powder-metallurgical production of sintered components is known per se from the prior art, reference is made to the relevant prior art in order to avoid repetitions in this regard.

In addition to the radially outer lateral surface 15, the rotor base body 14 of the rotor also has a radially inner lateral surface 33, a first front face 34 and a second front face 35, which is arranged opposite the first front face 34 as viewed in an axial direction 21. Further, the rotor base body 14 has an outer diameter 36 bounded by the radially outer lateral surface 15 and passing through a first axis of rotation, and an inner diameter 38 bounded by the radially inner lateral surface 33 and passing through a second axis of rotation 39.

Further, the rotor base body 14 has a radially inwardly projecting calibrated first annular web 40 on the inner lateral surface 33. As can be better seen from FIG. 2, this first annular web 40 has a web lateral surface 41 that bounds a bore passing through the rotor base body in the axial direction, i.e., the receptacle 22, with an inner diameter 42 that passes through a third axis of rotation 43.

Figure 6:
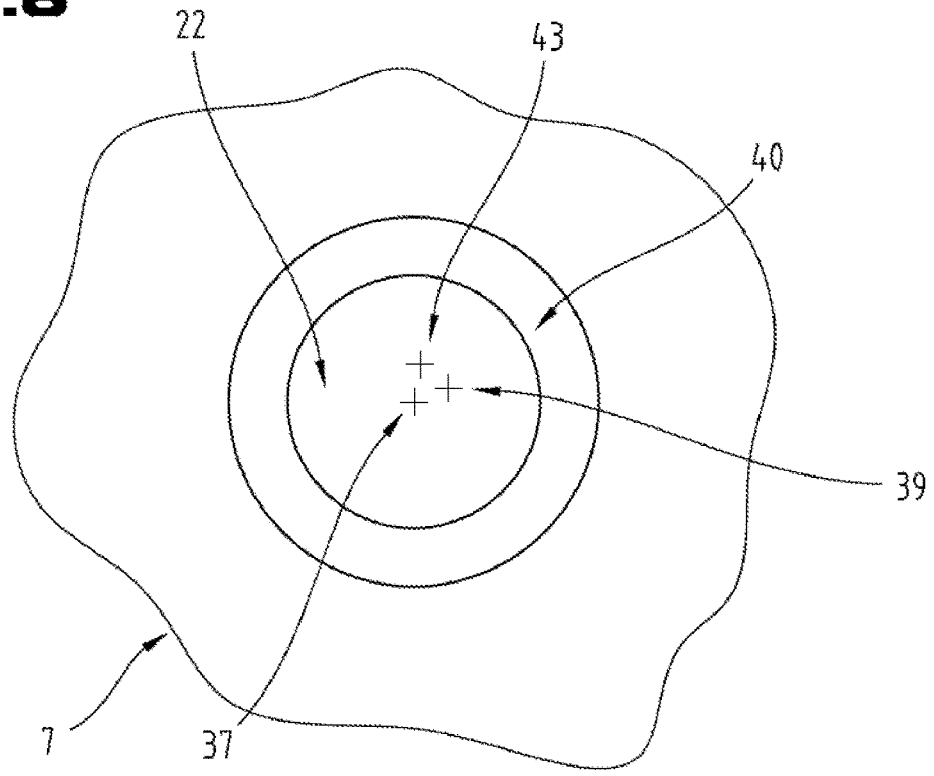
FIG. 6 a detail of a rotor.

For better illustration, the axes of rotation 38, 39 and 43 in FIG. 6 are shown exaggeratedly offset from each other.

It is now provided that the third axis of rotation is offset in the radial direction by a value relative to the first axis of rotation and/or the second axis of rotation, which is at most 0.1 mm. In particular, this value may be between 0.04 mm and 0.08 mm, preferably between 0.05 and 0.07.

It should be noted that preferably the first axis of rotation 37 coincides with the second axis of rotation 39.

The first annular web 40 may have a width in the axial direction 21 of between 2 mm and 15 mm, in particular between 2 mm and 10 mm. In particular, this width of the first annular web 40 may improve the calibration result.

For the sake of completeness, it should be noted that calibrating a sintered component is usually done to improve the accuracy of the dimensions of the sintered component. For this purpose, appropriate calibration tools are used, which have a high precision in terms of dimensions. With these tools, a correspondingly high pressure is applied to the sintered component after sintering. For the rotor 7, this means that it is accommodated in a calibration die and at least the annular web 40 is pressed with punches and a core bar, resulting in partial material displacement or compression.

As can be seen from FIG. 2, at least one further annular web 44 may be arranged in the axial direction 21 in addition to the first annular web 40. Preferably, the further annular web 44 is also calibrated.

In the particularly preferred embodiment, the complete rotor 7 is calibrated.

It should be mentioned at this point that the first annular web 40 and preferably the further annular web 44 are not subjected to any further mechanical processing, in particular machining, in addition to calibration after sintering, so that the first annular web 40 and preferably the further annular web 44 is/are finished after calibration.

To improve the calibratability of the further annular web 44, it may be provided that a distance 45 between the first annular web 40 and the further annular web 44 is selected from a range of 1 mm and 12 mm, in particular between 1 mm and 8 mm.

Figure 7:
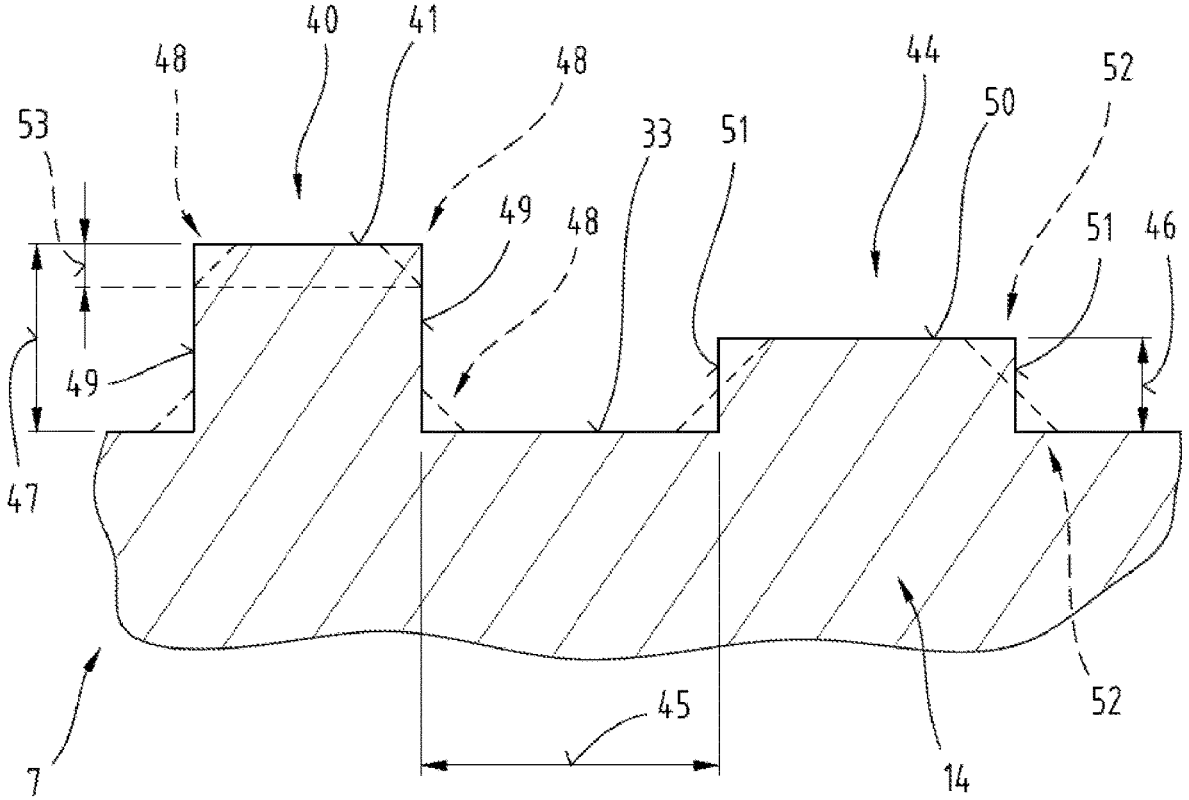
FIG. 7 another detail of a rotor.

Also to improve/simplify the calibratability of the first annular web 40 when a further annular web 44 is present, it may be provided that the further annular web 44 has a radial height 46 which is smaller than a radial height 47 of the first annular web 40, as can be seen more clearly from FIG. 7, which shows a section of the rotor 7 in the region of the first annular web 40 and the further annular web 44.

The radial height 46 of the further annular web 44 is preferably smaller than the radial height 47 of the first annular web 40 by a maximum of 20%. In particular, the radial height 46 of the further annular web 44 may be less than the radial height 47 of the first annular web 40 by a value selected from a range of 2% and 10% of the radial height 47 of the first annular web 40.

As FIG. 2 shows, however, it is also possible for the radial height 46 of the further annular web 44 to be the same as the radial height 47 of the first annular web 40.

As can be seen from FIG. 7, according to a further embodiment of the rotor 7 it may be provided that transitions 48 between the web lateral surface 41 and front faces 49 of the first annular web 40 directly adjoining the latter and/or between the front faces 49 of the first annular web 40 and the radially inner lateral surface 33 of the rotor base body 14 are rounded and/or faceted. FIG. 7 schematically shows both versions. The transitions 48 may also be only rounded or only faceted.

A rounding radius of the rounded transitions 48 may be selected from a range of 0.1 mm and 3 mm, particularly 0.5 mm and 2 mm, preferably from a range of 0.5 mm and 1 mm.

The oblique surfaces formed by the faceting at the transitions 48 may form an angle of between 10° and 90°, in particular between 30° and 50°, with the radially inner lateral surface 33 of the rotor base body 14.

According to a further embodiment of the rotor 7, the explanations regarding the transitions 48 of the first annular web 40 may also be applied to the further annular web 44 or each further annular web 44 on the inner lateral surface 33 of the rotor base body 14. In general, the explanations regarding the first annular web 40 may also be applied to any other annular web on the inner lateral surface 33 of the rotor base body 14.

Accordingly, it may be provided that the further annular web 44 has a further web lateral surface 50 and further front faces 51 directly adjoining the latter, and that transitions 52 between the further web lateral surface 50 and the further front faces 51 directly adjoining the latter and/or between the further front faces 51 of the further annular web 44 and the radially inner lateral surface 33 of the rotor base body 14 are rounded or faceted.

When calibrating the annular web 40 and possibly the further annular web 44, these are partially compressed. In accordance with one embodiment of the rotor 7, it may be provided that the annular web 40 and possibly the further annular web 44 in an outer layer with a layer thickness 53 of 0.5 mm have a maximum density of not less than 90%, or not less than 95%, and desirably between 96% and 99%, of the theoretical density of the sintering material. This outer layer may be formed below the web lateral surface 41 (and possibly the further web lateral surface 50) and/or below the front face(s) 49 (and possibly the further front face(s) 51).

It may also be provided that only the further annular web 44 has such a compacted outer layer at least in part.

The theoretical density is the density that the material would have if it had no pores, for example if it were a cast material.

The maximum density is the largest density in this outer layer. It may be provided that the complete outer layer has this maximum density. It may also be provided that a density gradient with decreasing density is formed starting from the surface of the annular web 40 (and possibly the further annular web 44) inwards. In this embodiment, the outer layer may also not fall below the maximum density at any point. On the other hand, it may also be provided that the maximum density is formed only over a partial area of the outer layer, for example in an outer partial layer of the outer layer.

The rotor 7 can be produced in net shape or near net shape quality at least in the area of the annular web 40 and possibly the further annular web 44.

For the sake of completeness, it should be mentioned that the camshaft adjuster 2 has a covering 8, 41 on both sides (on the axial end faces), by means of which the working spaces 18 are closed in the axial direction 21.

For the sake of completeness, it should be noted that metallic powders are particularly preferred as sintering powders, especially a sintered steel powder.

The embodiments show possible implementation variants of the camshaft adjuster 2 or of components thereof or of the rotor 7, wherein it should be noted at this point that combinations of the individual embodiments with one another are also possible.

Finally, as a matter of form, it should be noted that for ease of understanding of the camshaft adjuster 2 and/or its elements, these are not necessarily depicted to scale.

It will be obvious to those having skill in the art that many changes may be made to the details of the above-described embodiments without departing from the underlying principles of the invention. The scope of the present invention should, therefore, be determined only by the following claims.

The invention claimed is:

1. A powder-metallurgically produced rotor for a camshaft adjuster made of a sintering material, comprising a rotor base body, having a radially outer lateral surface and a radially inner lateral surface, as well as a first front face and a second front face, which is arranged opposite the first front face as viewed in an axial direction, wherein the rotor base body has an outer diameter bounded by the radially outer lateral surface and passing through a first axis of rotation, and an inner diameter bounded by the radially inner lateral surface and passing through a second axis of rotation, and which has blades projecting radially outward from the radially outer lateral surface and a calibrated first annular web projecting radially inward on the inner lateral surface, which has a web lateral surface defining a bore passing through the rotor base body in the axial direction and having an inside diameter passing through a third axis of rotation, wherein the third axis of rotation is offset in the radial direction by a value relative to the first axis of rotation and/or the second axis of rotation, which is at most 0.1 mm.

2. The rotor according to claim 1, wherein the third axis of rotation is offset in the radial direction by a value relative to the first axis of rotation and/or the second axis of rotation, which is between 0.04 mm and 0.08 mm.

3. The rotor according to claim 1, wherein a further annular web is arranged downstream of and spaced from the first annular web in the axial direction.

4. The rotor according to claim 3, wherein the further annular web has a radial height that is smaller than a radial height of the first annular web.

5. The rotor according to claim 1, wherein transitions between the web lateral surface and front faces of the first annular web directly adjoining the latter and/or between the front faces of the first annular web and the radially inner lateral surface of the rotor base body are rounded and/or faceted.

6. The rotor according to claim 4, wherein transitions between the web lateral surface and front faces of the first annular web directly adjoining the latter and/or between the front faces of the first annular web and the radially inner lateral surface of the rotor base body are rounded and/or faceted.

7. The rotor according to claim 4, wherein the further annular web has a further web lateral surface and further front faces directly adjoining the latter, and that transitions between the further web lateral surface and the further front faces directly adjoining the latter and/or between the further front faces of the further annular web and the radially inner lateral surface of the rotor base body are rounded or faceted.

8. The rotor according to claim 5, wherein the further annular web has a further web lateral surface and further front faces directly adjoining the latter, and that transitions between the further web lateral surface and the further front faces directly adjoining the latter and/or between the further front faces of the further annular web and the radially inner lateral surface of the rotor base body are rounded or faceted.

9. The rotor according to claim 6, wherein the further annular web has a further web lateral surface and further front faces directly adjoining the latter, and that transitions between the further web lateral surface and the further front faces directly adjoining the latter and/or between the further front faces of the further annular web and the radially inner lateral surface of the rotor base body are rounded or faceted.

10. The rotor according to claim 1, wherein the annular web in an outer layer with a layer thickness of 0.5 mm has a maximum density of not less than 95% of the theoretical density of the sintering material.

11. A hydraulic camshaft adjuster for variably adjusting the timing of gas exchange valves of an internal combustion engine comprising:

a stator, a rotor according to claim 1 at least partially surrounded by the stator, and a control valve at least partially surrounded by the rotor.

12. A hydraulic camshaft adjuster for variably adjusting the timing of gas exchange valves of an internal combustion engine comprising:

a stator, a rotor according to claim 2 at least partially surrounded by the stator, and a control valve at least partially surrounded by the rotor.

13. A hydraulic camshaft adjuster for variably adjusting the timing of gas exchange valves of an internal combustion engine comprising:

a stator, a rotor according to claim 3 at least partially surrounded by the stator, and a control valve at least partially surrounded by the rotor.

14. A hydraulic camshaft adjuster for variably adjusting the timing of gas exchange valves of an internal combustion engine comprising:

a stator, a rotor according to claim 4 at least partially surrounded by the stator, and a control valve at least partially surrounded by the rotor.

15. A hydraulic camshaft adjuster for variably adjusting the timing of gas exchange valves of an internal combustion engine comprising:

a stator, a rotor according to claim 5 at least partially surrounded by the stator, and a control valve at least partially surrounded by the rotor.

16. A hydraulic camshaft adjuster for variably adjusting the timing of gas exchange valves of an internal combustion engine comprising:

a stator, a rotor according to claim 6 at least partially surrounded by the stator, and a control valve at least partially surrounded by the rotor.

17. A hydraulic camshaft adjuster for variably adjusting the timing of gas exchange valves of an internal combustion engine comprising:

a stator, a rotor according to claim 7 at least partially surrounded by the stator, and a control valve at least partially surrounded by the rotor.

18. A hydraulic camshaft adjuster for variably adjusting the timing of gas exchange valves of an internal combustion engine comprising:

a stator, a rotor according to claim 8 at least partially surrounded by the stator, and a control valve at least partially surrounded by the rotor.

19. A hydraulic camshaft adjuster for variably adjusting the timing of gas exchange valves of an internal combustion engine comprising:

a stator, a rotor according to claim 9 at least partially surrounded by the stator, and a control valve at least partially surrounded by the rotor.

20. A hydraulic camshaft adjuster for variably adjusting the timing of gas exchange valves of an internal combustion engine comprising:

a stator, a rotor according to claim 10 at least partially surrounded by the stator, and a control valve at least partially surrounded by the rotor.

* * * * *